US010687686B2

(12) United States Patent
Brewer et al.

(10) Patent No.: US 10,687,686 B2
(45) Date of Patent: Jun. 23, 2020

(54) DISHWASHER APPLIANCE DOORS AND LIGHT ASSEMBLIES

(71) Applicant: Haier US Appliance Solutions, Inc., Wilmington, DE (US)

(72) Inventors: Kyle James Brewer, Louisville, KY (US); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/109,841

(22) Filed: Aug. 23, 2018

(65) Prior Publication Data

US 2020/0060508 A1 Feb. 27, 2020

(51) Int. Cl.
*A47L 15/42* (2006.01)

(52) U.S. Cl.
CPC ..... *A47L 15/4257* (2013.01); *A47L 15/4293* (2013.01)

(58) Field of Classification Search
CPC ..... A47L 15/4257
See application file for complete search history.

(56) References Cited

U.S. PATENT DOCUMENTS 9,683,731 B2 6/2017 Kim et al.
2017/0188787 A1 7/2017 Min et al.

FOREIGN PATENT DOCUMENTS

CN 204427974 U 7/2015
JP 4786992 B2 10/2011

*Primary Examiner* — Jason Y Ko
(74) *Attorney, Agent, or Firm* — Dority & Manning, P.A.

(57) ABSTRACT

The dishwasher door may include a forward door panel, a light source, and an indicator lens. The forward door panel may define an indicator aperture. The light source may be directed downward along a vertical direction. The indicator lens may be spaced apart from the light source along the vertical direction. The indicator lens may extend from a projection surface to a receiving surface. The receiving surface may face the light source to receive a light emission therefrom. The indicator lens may define a projection path directing at least a portion of the light emission through the indicator aperture and from the projection surface.

20 Claims, 6 Drawing Sheets

DISHWASHER APPLIANCE DOORS AND LIGHT ASSEMBLIES

FIELD OF THE INVENTION

The present subject matter relates generally to appliance light assemblies, and more particularly to appliance light assemblies for the door of a dishwasher appliance.

BACKGROUND OF THE INVENTION

Dishwasher appliances generally include a tub that defines a wash chamber for receipt of articles for washing. A door provides or permits selective access to the wash chamber. For example, the door can be rotatably mounted to the wash tub with a hinge. The door can selectively adjust between an open and a closed position by rotating about the hinge in order to permit access to the wash chamber.

In existing appliances, one or more lights are often provided with a control panel as part of a discrete attachment or assembly mounted to a front portion of the door. By illuminating a portion of the door, the lights may generally communicate relevant information regarding the dishwasher appliance. Although such lights may be useful in providing information, they can be difficult to install or arrange within the door. This may be especially true if one or more inputs (e.g., buttons) are provided along a top portion of the door (e.g., perpendicular to the lights at a front portion of the door). Multiple unique and separated circuit boards may be required to support the input buttons and lights. However, this may increase the expense and complexity of the door. Moreover, it may limit the size, number, and intensity of the lights which may be used. These limitations may reduce the appearance and perceived quality of the dishwasher appliance. The limitations may also hinder the efficacy of the visual indication or communication provided by the lights.

As a result, further improvements for dishwasher doors may be desirable. In particular, it would be advantageous to provide a door with a visual indicator or light that would not significantly increase the complexity or space requirements within a door. Moreover, it may be advantageous to provide a door with a visual indicator that would not cause confusion and could enhance the efficacy thereof.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher door is provided. The dishwasher door may include a forward door panel, a light source, and an indicator lens. The forward door panel may define an indicator aperture. The light source may be directed downward along a vertical direction. The indicator lens may be spaced apart from the light source along the vertical direction. The indicator lens may extend from a projection surface to a receiving surface. The receiving surface may face the light source to receive a light emission therefrom. The projection surface may be nonparallel to the receiving surface. The indicator lens may define a projection path directing at least a portion of the light emission through the indicator aperture and from the projection surface.

In another exemplary aspect of the present disclosure, a dishwasher door is provided. The dishwasher door may include a forward door panel, a light source, and an indicator lens. The forward door panel may define an indicator aperture. The light source may be directed downward along a vertical direction. The indicator lens may be spaced apart from the light source along the vertical direction. The indicator lens may extend from a projection surface to a receiving surface. The receiving surface may face the light source to receive a light emission therefrom. The projection surface may define a noncircular surface area greater than a noncircular surface area defined by the receiving surface. The indicator lens may define a projection path directing at least a portion of the light emission through the indicator aperture and from the projection surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
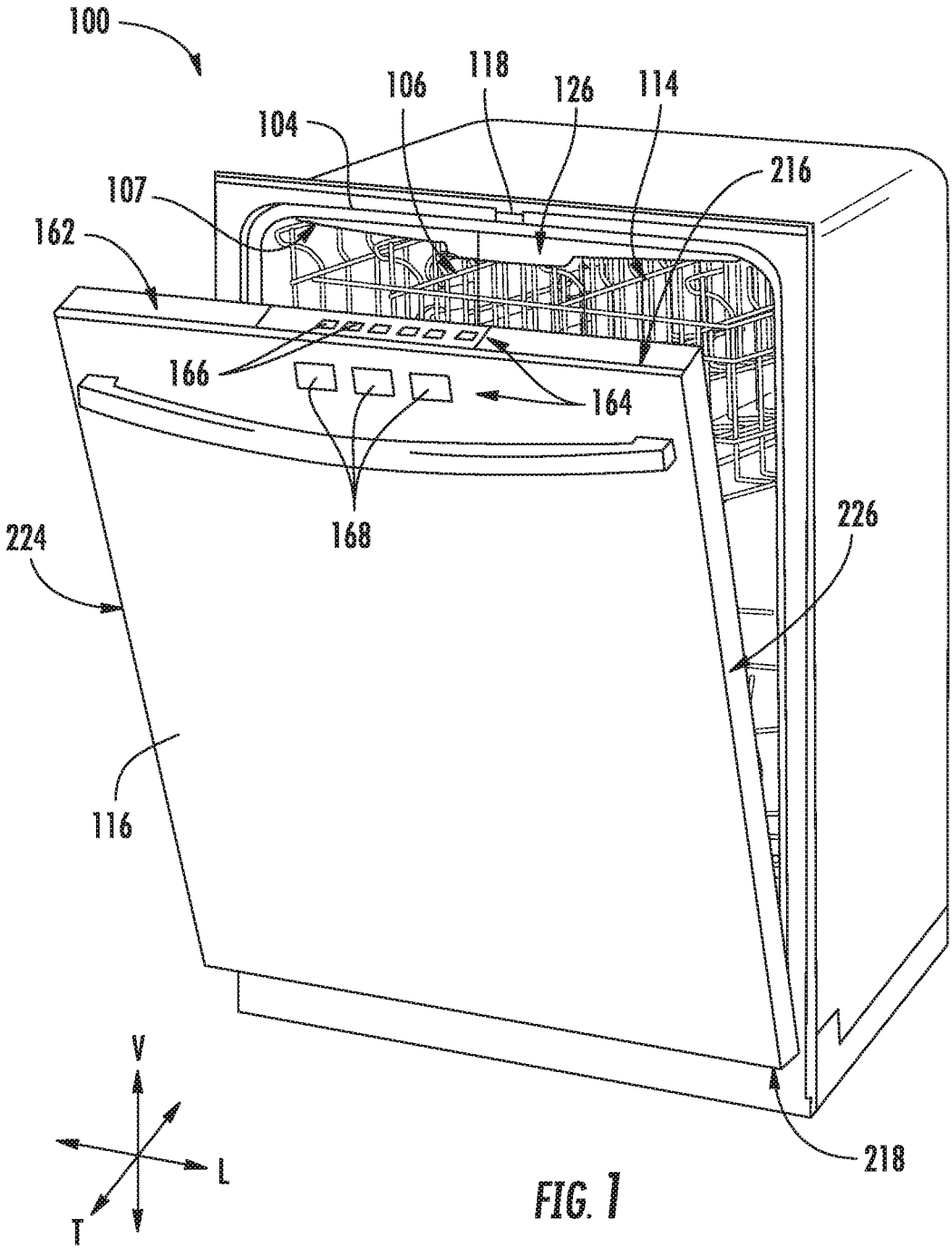
FIG. 1 provides a perspective view of a dishwasher appliance, including a dishwasher door according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). Furthermore, as used herein, terms of approximation, such as "approximately" or "substantially," refer to being within a ten percent margin of error.

Figure 2:
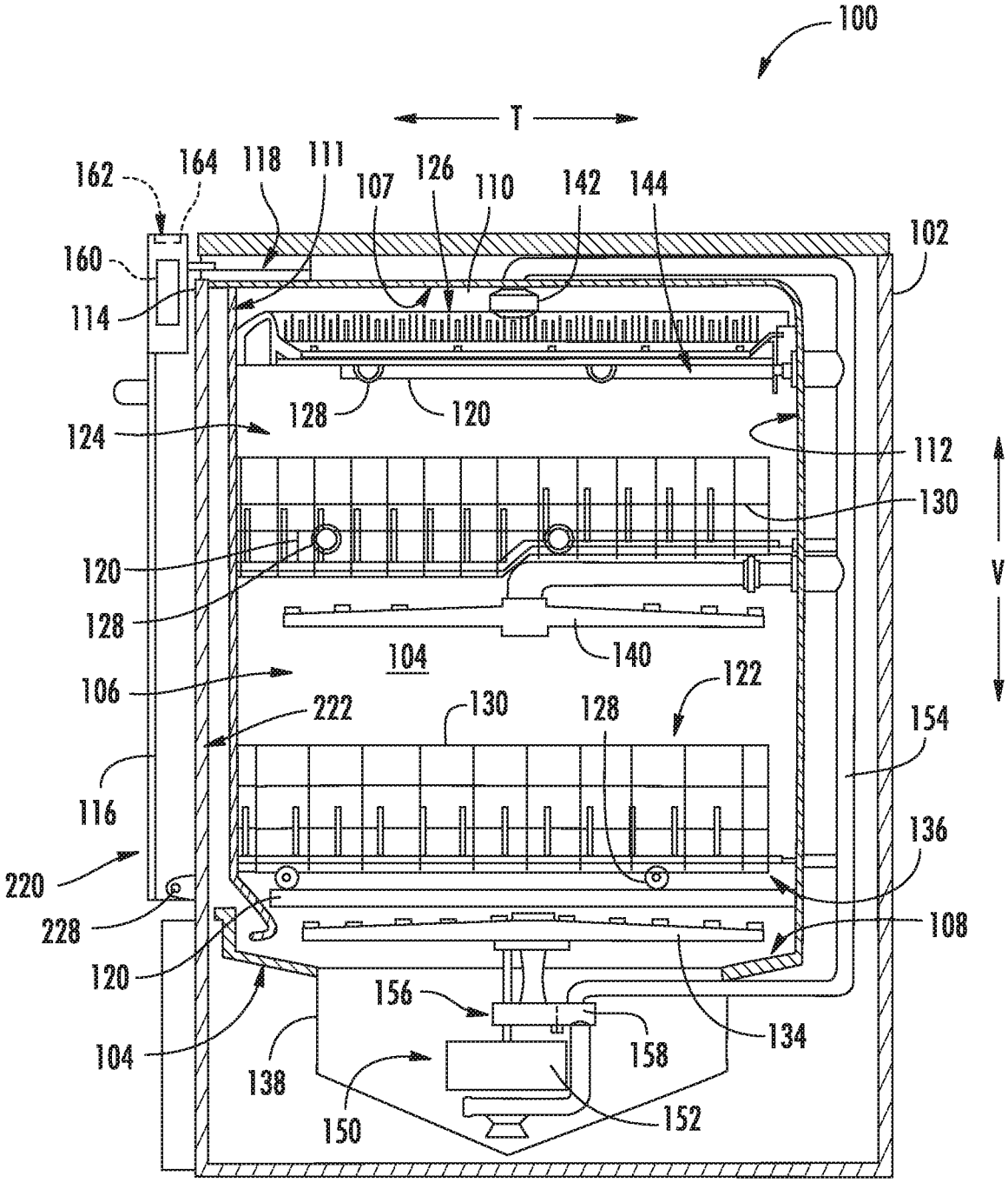
FIG. 2 provides a cross-sectional side view of the exemplary dishwashing appliance of FIG. 1.
Figure 3:
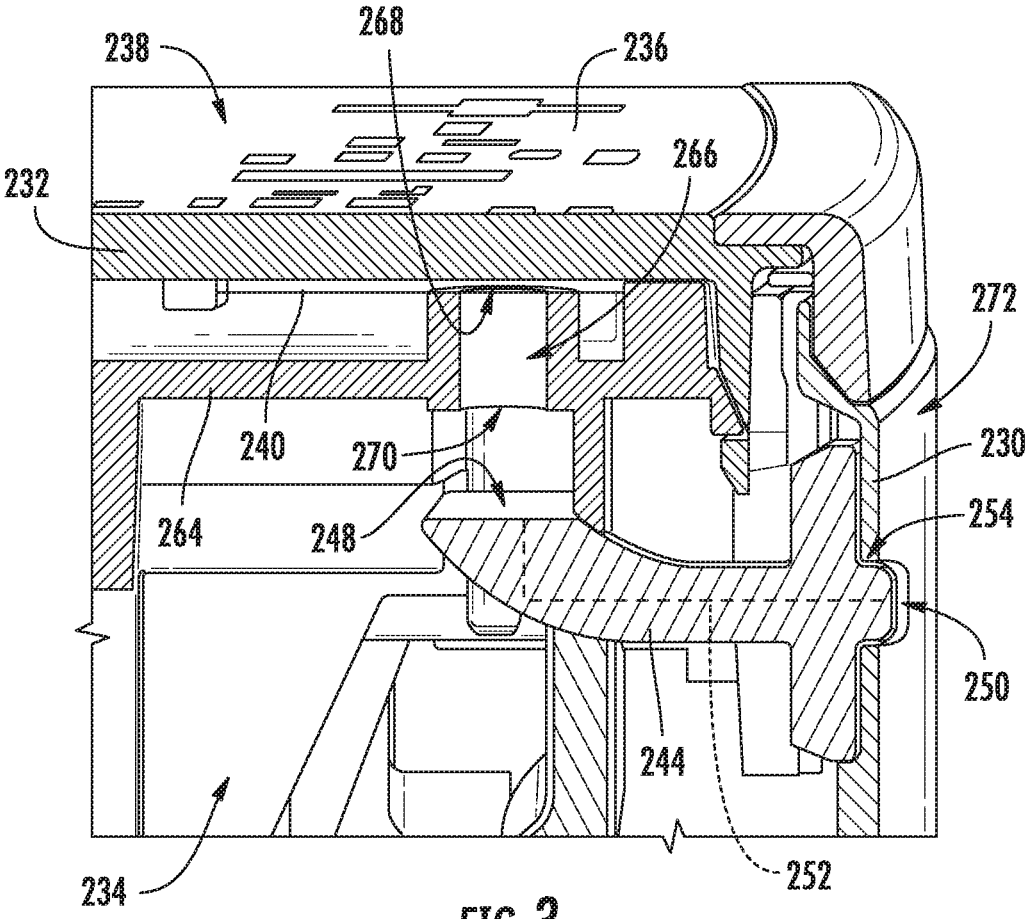
FIG. 3 provides a cross-sectional perspective view of a top portion of a dishwasher door, including a visual indicator, according to exemplary embodiments of the present disclosure.
Figure 4:
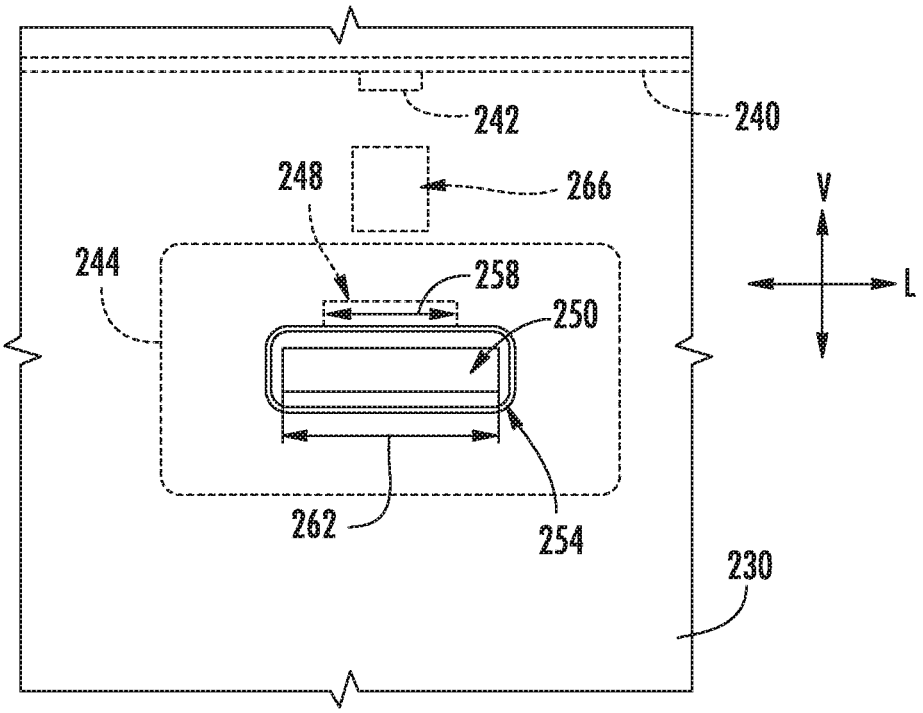
FIG. 4 provides a front view of the visual indicator of the exemplary dishwasher door of FIG. 3.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. In the normally closed position, door 116 extends from a top end 216 to a bottom end 218 along the vertical direction V; from a front end 220 to a rear end 222 along the transverse direction T; and between two lateral ends 224, 226 along the lateral direction L. A pivot axis 228 may be defined on the door 214 (e.g., by one or more lateral pivot hinges or pins), for example, parallel to the lateral direction L at or proximal to bottom end 218. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. As shown, one or more user inputs 166 (e.g., buttons) of user interface 164 may be positioned at a top end 216 of door 116 (e.g., on or through a top wall of door 116). The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

Turning now generally to FIGS. 3 through 8, portions of a door according to exemplary embodiments of the present disclosure are provided. As described above, it is understood that, the door may be mounted on dishwasher appliance 100 (FIG. 1). In turn, the mutually-orthogonal vertical direction V, lateral direction L, and transverse direction T defined by the door of FIGS. 3 through 8, and discussed below, generally correspond to the vertical direction V, lateral direction L, and transverse direction T, discussed above with regards to FIGS. 1 and 2 (e.g., when door 116 is in the normally closed position).

As shown, the door may include one or more exterior panels formed about and defining an interior chamber 234 of the door. For instance, a forward door panel 230 may be positioned at or proximal to the front end 220 (i.e., distal to the rear end 222). A top panel 232 may be positioned on or otherwise attached to forward door panel 230 at the top end 216 of the door. For instance, top panel 232 may extend rearward from forward door panel 230 along the transverse direction T. In certain embodiments, top panel 232 is positioned perpendicular (i.e., at substantially 90° relative to) forward door panel 230. As should be understood, in some embodiments, forward door panel 230 covers substantially all of the door along the vertical direction V and generally extend from the top end 216 to the bottom end 218 (FIGS. 1 and 2). In additional or alternative embodiments, top panel 232 covers substantially all of the door along the transverse direction T and generally extends from the front end 220 to the rear end 222 (FIG. 2). One or both of forward door panel 230 or top panel 232 may extend from the first lateral end 224 to the second lateral end 226 (FIGS. 1 and 2).

In some embodiments, top panel 232 includes or is provided as a capacitive interface panel 236 (e.g., as part of user interface 164—FIG. 1). As is understood, capacitive interface panel 236 may include one or more user inputs or controls (e.g., inputs 166 to direct or control operations of the dishwasher appliance 100—FIG. 1) on a top surface 238 facing upward to receive a user's engagement or touch thereon. When assembled, capacitive interface panel 236 may be operably coupled to the controller 160. As shown, capacitive interface panel 236 may include a control board 240 (e.g., as part of the controller 160—FIG. 2) positioned below the top surface 238. Thus, control board 240 may be generally hidden from view and within interior chamber 234. In some such embodiments, control board 240 is mounted behind or rearward from forward door panel 230 along the transverse direction T.

Generally, a light source 242 is positioned within interior chamber 234 to provide light (e.g., light emissions 246) to illuminate an indicator lens 244 that may be visible to a user outside of interior chamber 234. As should be understood, the light source 242 and indicator lens 244 may generally correspond to a single indicator light (e.g., a display component 168—FIGS. 1 and 2). Thus, although FIGS. 3 through 8 illustrate a single light source 242 and corresponding indicator lens 244, it is understood that exemplary embodiments may include multiple similar light sources and indicator lenses, each corresponding to one or more unique display components (e.g., display components 168).

As shown in FIGS. 3 through 8, light source 242 may be mounted to control board 240 below top panel 232. Additionally or alternatively, light source 242 may be mounted behind or rearward from forward door panel 230. Light source 242 may be provided as any suitable electrical light source, such as a light-emitting diode (LED), fluorescent bulb, halogen bulb, etc. Moreover, light source 242 may be operably coupled (e.g., electrically coupled) to control board 240 or controller 160 (FIG. 2). Activation or illumination of light source 242 may be generally controlled by control board 240 or controller 160 (e.g., to indicate a user input, state of the dishwasher appliance, state of the wash cycle, or any other relevant information to a user).

In some embodiments, light source 242 is directed substantially downward along the vertical direction V. Thus, when activated to illuminate indicator lens 244, light source 242 may project light emissions 246 along the vertical direction V and generally toward the bottom end 218 (FIG. 2), opposite top panel 232.

Generally, indicator lens 244 may be formed from a suitable transparent or translucent material configured to direct light emissions 246 therethrough (e.g., glass, polycarbonate, acrylic, etc.). When assembled, indicator lens 244 spaced apart from light source 242 along the vertical direction V. In particular, at least a portion of indicator lens 244 is positioned below light source 242. Indicator lens 244 itself may extend from a receiving surface 248 to projection surface 250 that is nonparallel (e.g., perpendicular or set in another suitable angle between 0° and 180°) relative to receiving surface 248. Receiving surface 248 may face light source 242 (e.g., from a position above light source 242) to receive a light emission 246 therefrom. A projection path 252 for light emissions 246 may be defined through indicator lens 244 from receiving surface 248 to projection surface 250. Thus, at least a portion of the light emission 246 received at receiving surface 248 may be directed to projection surface 250 and then, for example, to a user facing the door.

An indicator aperture 254 is defined through forward door panel 230. As shown, indicator aperture 254 may extend along the transverse direction T to permit light emissions 246 therethrough. For instance, indicator aperture 254 may be defined as a void extending fully through forward door panel 230 (e.g., completely through forward door panel 230 along the transverse direction T). In some such embodiments, at least a portion of indicator lens 244 (e.g., projection surface 250) is received through indicator aperture 254. In alternative embodiments, however, indicator aperture 254 is defined as a nonpermeable (e.g., to water) segment of forward door panel 230 through which light emissions 246 may pass. As an example, indicator aperture 254 may be a transparent or translucent portion of forward door panel 230 that generally permits at least a portion of visible light therethrough (e.g., from interior chamber 234 to the ambient environment surrounding the door). When light source 242 is activated or illuminated, light emissions 246 from light source 242 may thus be directed along projection path 252 from receiving surface 248 and through indicator aperture 254. Advantageously, the relative position of light source 242, indicator lens 244, and indicator aperture 254 may permit a significant amount light to be directed through interior chamber 234 along the projection path 252 and reduce the overall transverse depth that may be required for interior chamber 234. Moreover, the described embodiments may permit light source 242 to be mounted on control board 240, further reducing complexity and space requirements within the door.

In some embodiments, one or both of receiving surface 248 and projection surface 250 define a corresponding noncircular surface area. As an example, receiving surface 248 may have a transverse receiving length 256 and a lateral receiving width 258 defining a noncircular surface area of receiving surface 248 (e.g., below light source 242). Projection surface 250 may have a vertical projection height 260 and a lateral projection width 262 defining a noncircular surface area of projection surface 250 (e.g., in front of or forward from light source 242 and receiving surface 248). In certain embodiments, the noncircular surface area defined by projection surface 250 is greater than the noncircular surface area defined by receiving surface 248. In other words, the surface area magnitude and dimensions of projection surface 250 may be larger than those of receiving surface 248. Advantageously, the noncircular surface area defined by projection surface 250 may be more easily viewed (and thereby understood) than typical visual indicator lights (e.g., having a relatively small or circular shape).

Exemplary embodiments include an internal bracket 264 mounted within interior chamber 234. Thus, an internal bracket 264 may be positioned behind forward door panel 230 along the transverse direction T or below top panel 232 along the vertical direction V. In optional embodiments, internal bracket 264 is fixed within interior chamber 234 (e.g., mounted to an inner door or inner frame—not pictured). In some embodiments, light source 242 is supported on or above internal bracket 264. As an example, light source 242 may be attached to control board 232 above internal bracket 264. Optionally, control board 232 and light source 242 may be attached to internal bracket 264. In certain embodiments, light source 242 is positioned above receiving surface 248 (e.g., along the vertical direction V) and at least a portion of internal bracket 264. In additional or alternative embodiments, internal bracket 264 defines a light channel 266 extending therethrough. In particular, light channel 266 may extend along the vertical direction V (e.g., generally along the vertical direction V such that one opening of the light channel 266 is positioned below the other opening of the light channel 266) between light source 242 and receiving surface 248.

Figure 5:
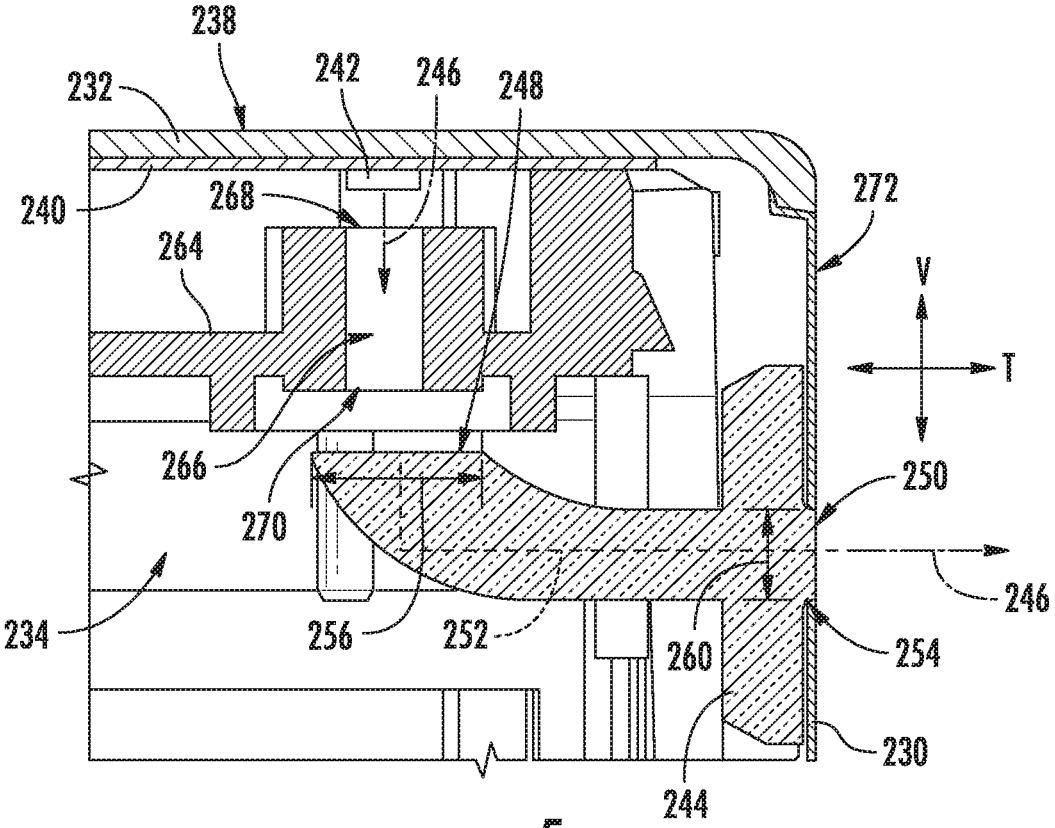
FIG. 5 provides a cross-sectional side view of a top portion of the exemplary dishwasher door of FIG. 3.

As shown in FIG. 5, light channel 266 may be defined as a linear void (e.g., parallel to the vertical direction V). Thus, a constant channel width (e.g., perpendicular to the vertical direction V) may be defined between a first opening 268 and a second opening 270. In some such embodiments, light channel 266 defines a cylindrical shape. However, another suitable shape may be formed. Additionally or alternatively, although FIG. 5 illustrates a light channel having a constant channel width that is substantially parallel to the vertical direction V, it is understood that light channel 266 (e.g., the walls defining light channel 266) may extend at a nonparallel angle relative to the vertical direction V (e.g., such that the light source 242 is transversely or laterally offset from the receiving surface 248).

Figure 6:
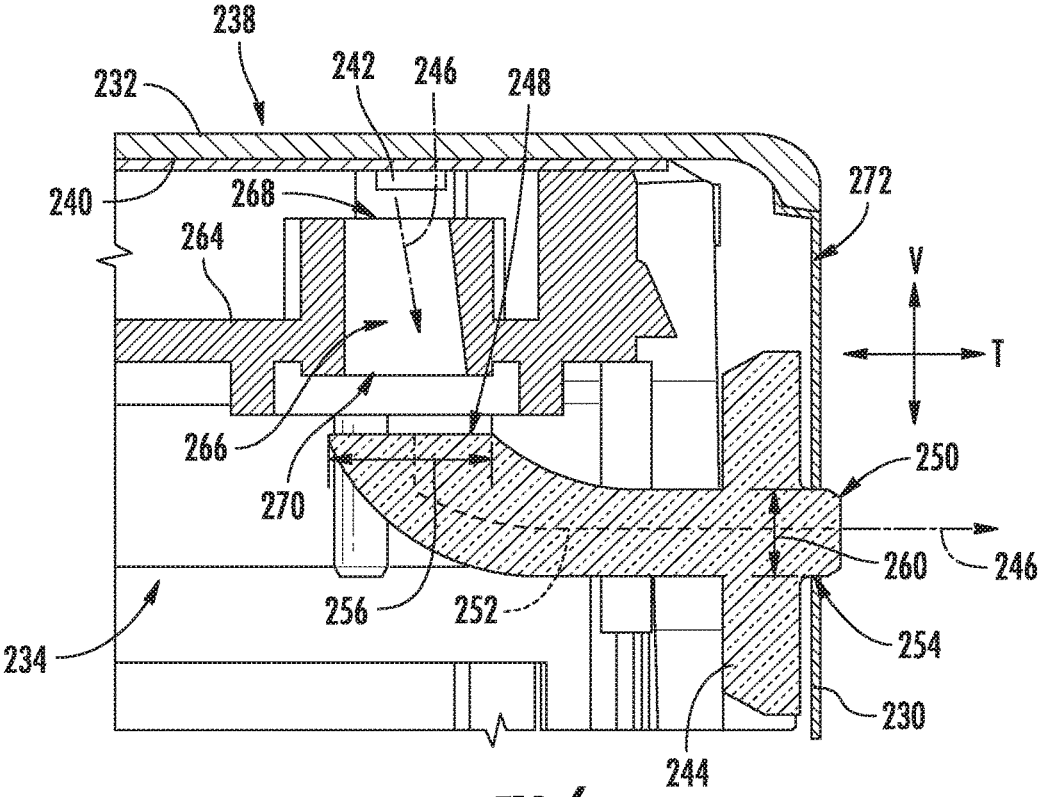
FIG. 6 provides a cross-sectional side view of a top portion of a dishwasher door, including a visual indicator, according to other exemplary embodiments of the present disclosure.

Turning briefly to FIG. 6, alternative embodiments may include a light channel 266 defined as a nonlinear void. In some such embodiments, light channel 266 is tapered (e.g., along the vertical direction V) from a large second opening 270 to a relatively small first opening 268. Thus, the cross-sectional area of light channel 266 may generally increase from first opening 268 to second opening 270 positioned below first opening 268. In other words, the small opening may be positioned above the large opening (e.g., along the vertical direction V). Optionally, light channel 266 may direct light emissions 246 from light source 242 forward or rearward (e.g., along the transverse direction T). In other words, the taper of light channel 266 may be generally directed along a non-parallel angle relative to the vertical direction V. Advantageously, greater freedom and flexibility may be realized for mounting light source 242 relative to receiving surface 248. In some such embodiments, light channel 266 defines a cylindrical shape. However, another suitable shape may be formed.

Figure 7:
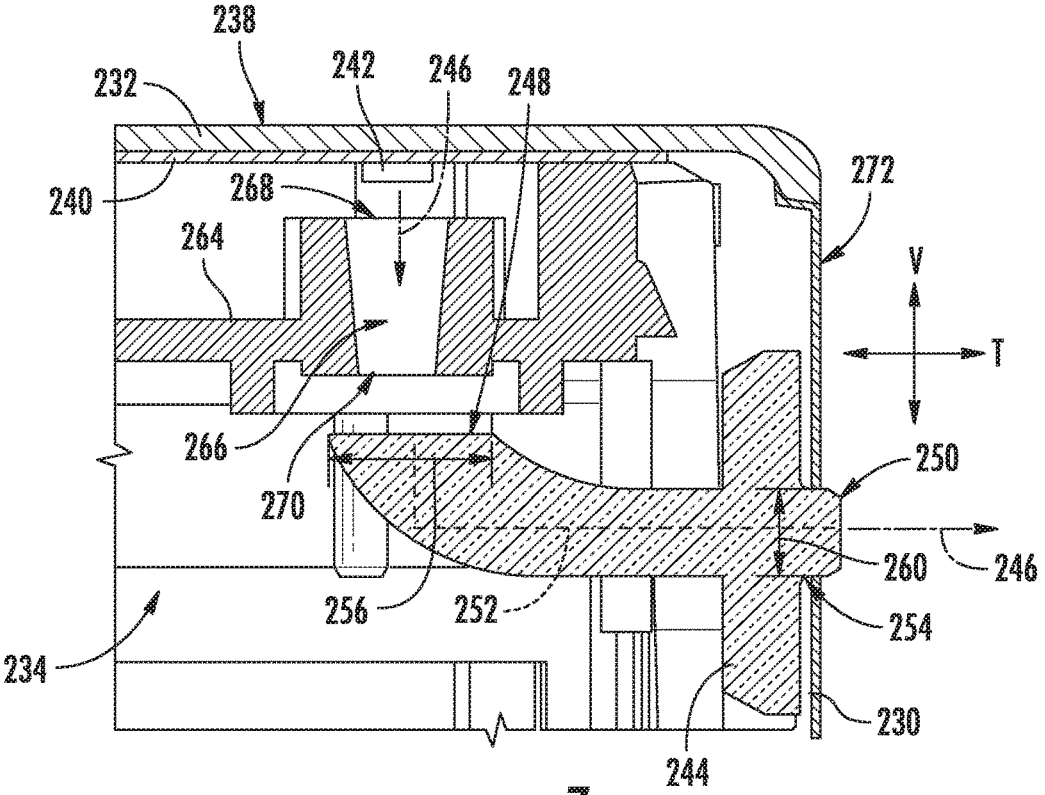
FIG. 7 provides a cross-sectional side view of a top portion of a dishwasher door, including a visual indicator, according to still other exemplary embodiments of the present disclosure.
Figure 8:
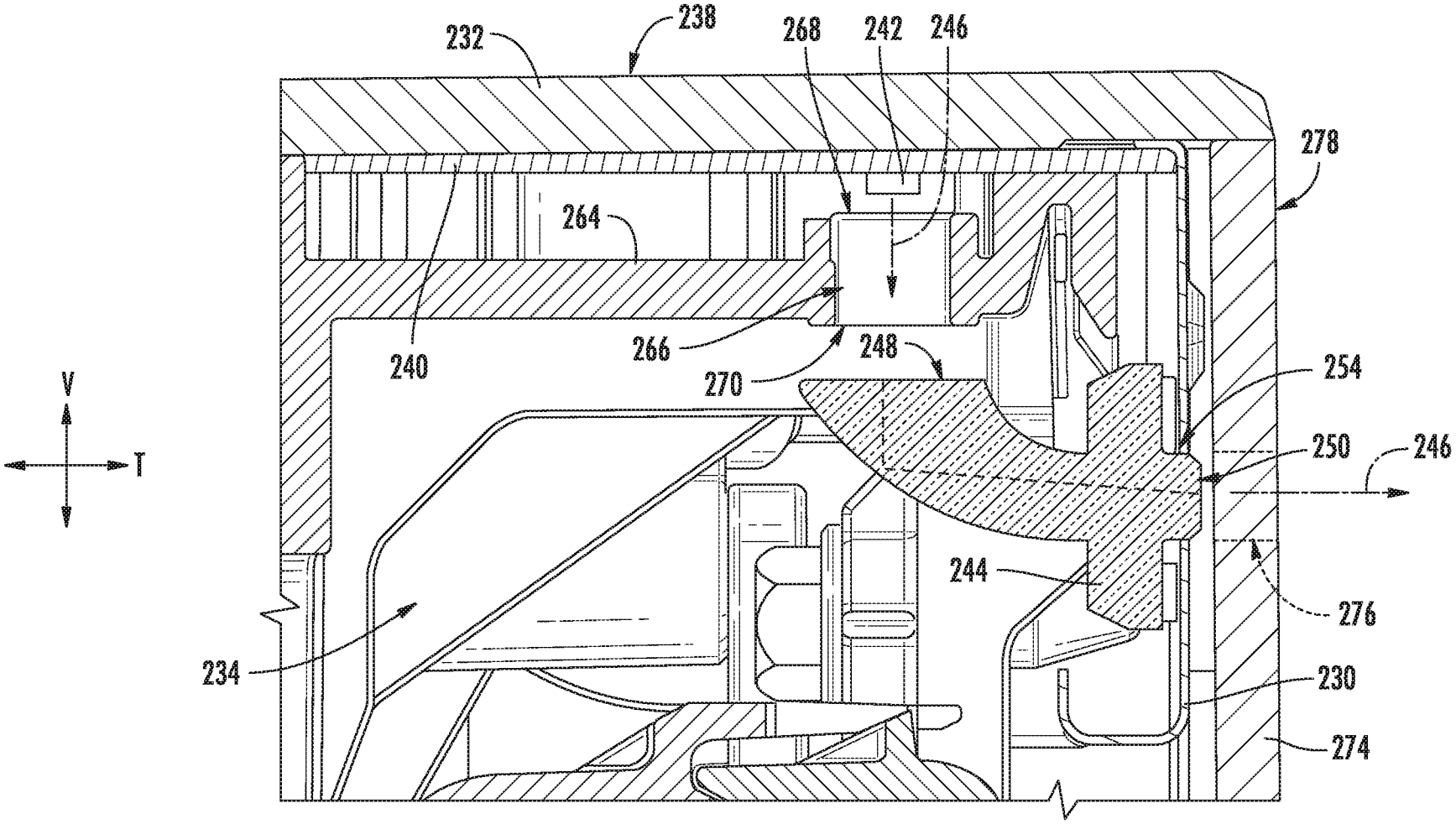
FIG. 8 provides a cross-sectional side view of a top portion of a dishwasher door, including a visual indicator, according to yet other exemplary embodiments of the present disclosure.

Turning briefly to FIG. 7, further alternative embodiments may include a light channel 266 defined as a nonlinear void. In some such embodiments, light channel 266 is tapered from a large first opening 268 to a relatively small second opening 270. Thus, the cross-sectional area of light channel 266 may generally decrease from first opening 268 to second opening 270 positioned below first opening 268. In other words, the small opening may be positioned below the large opening (e.g., along the vertical direction V). Advantageously, the taper may focus light emissions 246 from light source 242, increasing the visibility and intensity of the light visible at projection surface 250. In some such embodiments, light channel 266 defines a cylindrical shape. However, another suitable shape may be formed.

Turning generally to FIGS. 3 through 8, some embodiments include at least a portion of indicator lens 244 extending through indicator aperture 254 (e.g., along the transverse direction T).

In some such embodiments, forward door panel 230 is generally open to the ambient environment and defines an outermost or exterior surface 272 (e.g., such that a user may touch or contact the door at exterior surface 272 defined by forward door panel 230). For instance, projection surface 250 may be framed by or positioned within indicator aperture 254. Optionally, projection surface 250 may be in flushed vertical alignment with an exterior surface 272 defined by forward door panel 230, as illustrated in FIG. 5. In other embodiments, such as those illustrated in FIGS. 6 and 7, projection surface 250 may be positioned forward from forward door panel 230. This may further result in projection surface 250 being positioned forward from the exterior surface 272 defined by forward door panel 230, In alternative embodiments, such as those illustrated in FIG. 8, forward door panel 230 is covered or blocked by an external panel 274 positioned in front of forward door panel 230 (e.g., along the transverse direction T). For example, external panel 274 may define a footprint that covers forward door panel 230 in a plane perpendicular to the transverse direction T (e.g., in the vertical direction V and the lateral direction L). An outer face 278 of external panel 274 may thus define an exterior or outermost surface of the door along the transverse direction T. External panel 274 may be formed from one or more suitable solid or nonpermeable material, such as a plastic material (e.g., acrylic, polycarbonate, etc.) or ceramic material (e.g., glass or glass-ceramic). Advantageously, external panel 274 may resist the accumulation of foreign materials (e.g., dirt, grease, etc.) and be relatively easy to clean. Nonetheless, external panel 274 may define a solid light passage 276 of nonpermeable material. Solid light passage 276 may be in transverse alignment with indicator aperture 254. For instance, the entirety of external panel 274 may be substantially transparent or translucent, or alternatively, only a limited or discrete sub-portion of external panel 274 may be formed of uncovered transparent or translucent material. Thus, at least a portion of light emissions 246 directed from projection surface 250 may be transmitted through solid light passage 276 (e.g., into the ambient area in front of the door).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher door defining a mutually-orthogonal vertical, lateral, and transverse direction, the dishwasher door comprising:

a forward door panel defining an indicator aperture;

a light source directed downward along the vertical direction; and an indicator lens spaced apart from the light source along the vertical direction, the indicator lens extending from a projection surface to a receiving surface, the receiving surface facing the light source to receive a light emission therefrom, the projection surface being nonparallel to the receiving surface, the indicator lens defining a projection path directing at least a portion of the light emission through the indicator aperture and from the projection surface.

2. The dishwasher door of claim 1, wherein the dishwasher door extends along the vertical direction from a top end to a bottom end, wherein the dishwasher door further comprises a capacitive interface panel positioned at the top end perpendicular to the forward panel.

3. The dishwasher door of claim 2, wherein the capacitive interface panel comprises a control board mounted behind the forward door panel along the transverse direction, wherein the light source is mounted to the control board.

4. The dishwasher door of claim 1, further comprising an internal bracket positioned behind the forward door panel along the transverse direction and between the light source and the receiving surface along the vertical direction.

5. The dishwasher door of claim 4, wherein the internal bracket defines a light channel extending along the vertical direction between the light source and the receiving surface.

6. The dishwasher door of claim 5, wherein the light channel is tapered from a small opening to a large opening.

7. The dishwasher door of claim 1, wherein the indicator lens extends through the indicator aperture along the transverse direction.

8. The dishwasher door of claim 1, wherein the forward door panel defines an exterior surface, and wherein the projection surface is in flushed vertical alignment with the exterior surface.

9. The dishwasher door of claim 1, further comprising an external panel positioned in front of the forward door panel along the transverse direction, the external panel defining a solid light passage in transverse alignment with the indicator aperture to permit light transmission from the indicator aperture through the external panel.

10. The dishwasher door of claim 1, wherein the projection surface defines a vertical height and a lateral width, the lateral width being greater than the vertical height.

11. The dishwasher door of claim 1, wherein the projection surface defines a noncircular surface area greater than a noncircular surface area defined by the receiving surface.

12. The dishwasher door of claim 11, wherein the dishwasher door extends along the vertical direction from a top end to a bottom end, wherein the dishwasher door further comprises a capacitive interface panel positioned at the top end perpendicular to the forward panel.

13. The dishwasher door of claim 12, wherein the capacitive interface panel comprises a control board mounted behind the forward door panel along the transverse direction, wherein the light source is mounted to the control board.

14. The dishwasher door of claim 11, further comprising an internal bracket supporting the light source behind the forward door panel along the transverse direction and above the receiving surface along the vertical direction.

15. The dishwasher door of claim 14, wherein the internal bracket defines a light channel extending along the vertical direction between the light source and the receiving surface.

16. The dishwasher door of claim 15, wherein the light channel is tapered from a small opening to a large opening.

17. The dishwasher door of claim 11, indicator lens extends through the indicator aperture along the transverse direction.

18. The dishwasher door of claim 11, wherein the forward door panel defines an exterior surface, and wherein the projection surface is in flushed vertical alignment with the exterior surface.

19. The dishwasher door of claim 11, further comprising an external panel positioned in front of the forward door panel along the transverse direction, the external panel defining a solid light passage in transverse alignment with the indicator aperture to permit light transmission from the indicator aperture through the external panel.

20. The dishwasher door of claim 11, wherein the projection surface defines a vertical height and a lateral width, the lateral width being greater than the vertical height.

* * * * *